US006144619A

United States Patent [19]

Reisman

[11] Patent Number: 6,144,619

[45] Date of Patent: Nov. 7, 2000

[54] FLIGHT WATCH WITH MULTIPLE TIMERS AND ALARM INDICATING MEANS

[76] Inventor: John P. Reisman, 321 W. Kalmia St., Fallbrook, Calif. 92028-1922

[21] Appl. No.: 09/184,928

[22] Filed: Nov. 2, 1998

[51] Int. Cl.[7] ..... G04B 47/00; G04B 19/22; G04C 19/00; G04F 10/00

[52] U.S. Cl. ..... 368/10; 368/21; 368/82; 368/107

[58] Field of Search ..... 368/6, 10, 14, 368/82–84, 107–113

[56] References Cited

U.S. PATENT DOCUMENTS

| | | | |
|---|---|---|---|
| 3,820,105 | 6/1974 | Assmus | 340/309.4 |
| 4,236,375 | 12/1980 | Komaki | 368/73 |
| 4,290,728 | 9/1981 | Estabrook | 368/1 |
| 4,731,603 | 3/1988 | McRae | 340/407.1 |
| 5,233,572 | 8/1993 | McCarty | 368/107 |
| 5,282,181 | 1/1994 | Entner | 368/73 |
| 5,361,241 | 11/1994 | Ferrara | 368/281 |
| 5,365,497 | 11/1994 | Born | 368/230 |
| 6,043,758 | 3/2000 | Snyder, Jr. et al. | 340/970 |

*Primary Examiner*—Vit Miska

[57] ABSTRACT

An improved timepiece to be worn by pilots of aircraft which provides a means to alert the pilot of multiple sequenced event occurrences, in a failsafe manner, via multiple alarm means including visual (29–32), auditory (36), and tactile (37) ability. The six in-flight timers, accessible through buttons (1–4), allow the pilot comprehensive user progranmable features in order to meet the needs of a given flight. This watch solves previously unrecognized problems with regard to in-flight timing needs in general aviation. This watch is an electronic watch, specifically designed for pilots to address the plurality of in-flight timing needs, and includes a failsafe method by which to alert the wearer of time reliant in-flight, and post-flight, event occurrences. This watch also provides instant access to Zulu time and all forty-two time zones around the world. This watch is designed to assist the pilot in his awareness of engine run time, fuel tank switching time, final approach fix to missed approach point time, countdown to instrument flight rule and visual flight rule minimums, time to fix, timed turns, holding pattern timing, and time to close flight plan.

3 Claims, 3 Drawing Sheets

FLIGHT WATCH WITH MULTIPLE TIMERS AND ALARM INDICATING MEANS

BACKGROUND

1. Field of Invention

This invention relates to aviation alarm indicators, particularly to aviation alarm indicators worn by pilots.

2. Description of Prior Art

Current flight timing watches/devices are used to alert pilots of event occurrences. They typically provide an inadequate number of timers or ineffective means of relating the occurrence of an elapsed timed event. They are also gadget-like and provide more flash than function on the wrist of a pilot, and in an aircraft cockpit. Most flight timing watches/devices perform at least one timing function. Some can perform up to three concurrent timing functions. The pilot in accordance with the needs of the flight determines the application of the function. In-flight applications can include count up or countdown functions for engine run time, time to switch fuel tanks, time to fix (navigational point in space determined by electronic radio means or dead reckoning), final approach fix (FAF) to missed approach point (MAP), countdown to instrument flight rule minimums, or countdown to visual flight rule minimums.

A flight timing watch/device includes handheld, stick-on, clip-on, or user-wearable watches/devices. Some of these watches/devices perform other non-timing related functions as indicated below.

Current flight timing watches/devices are designed to provide a means by which the pilot can track timing related in-flight needs. The Federal Aviation Administration (FAA) approves of the use of most basic timing watches/devices in the cockpit, but recommends comprehensive attention to all available resources to ensure flight safety. Most of this is accomplished in preflight planning. After that it is up to the pilot to remember to check the watch/device.

Current flight timing watches/devices include 1 to 3 timers mounted in a square plastic encasement measuring approximately sixty by sixty-two millimeters. These watches/devices provide a means for the pilot to track various timing functions assignable at the discretion of the pilot regarding current need. These functions are made aware to the pilot by audible or visible indications. These watches/devices include a liquid-crystal display (LCD) and an audio alarm to indicate elapsed time.

Current flight watches/devices provide the pilot wearer with many options, including timing functions, altimeter, barometer, thermometer, compass, rate of climb or descent, and vertical feet climbed during a flight. However, the FAA for use in the cockpit does not consider watches/devices that provide such information, other than timing functions, reliable enough. This information is already available in the aircraft cockpit and is communicated to the pilot by FAA approved, installed, and inspected equipment. Luckily I have not yet met a pilot that would look at an unapproved watch/device, rather than the approved, installed equipment in the aircraft.

Today's flight watches/devices rely solely on audio, and the display of information on an LCD to inform the pilot of the occurrence of a timed event. This communication from the watch/device must compete with distractions in the cockpit, including noises of the engine, oncoming wind, headset attenuation, attention to the on-board control panels, operation of the aircraft, navigation, and communication. Often, in less advanced cockpits, flight watches/devices are rendered ineffective by their inability to compete with cockpit distractions.

Most watches/devices that claim to be flight watches/devices have little to do with anything regarding actual flight. Those watches/devices that are designed to be used in a cockpit, i.e. flight timers, cannot be considered failsafe due to the limitations of their design.

A timing device known as the Vibralite made by Global Assistive Devices in Fort Lauderdale, Fla. is a timing device that utilizes a silent alarm motor for tactile stimulation after an event occurrence. This was designed as an alarm mechanism for the hearing impaired. This watch uses a motor, which was developed by Namiki in Japan.

A recent addition to the flight watch/device family is the Triple Sensor Watch, by Casio Corporation, which is a flight watch/device to be worn by the pilot of an aircraft. This watch/device provides the wearer with a digital compass, altimeter, barometer, thermometer, and stopwatch. Other than the stopwatch, the FAA for use in flight recommends none of these functions. These functions are made known to the wearer through audio and visual means via an LCD. In addition, these functions require preprogramming by the pilot and periodic monitoring by the pilot.

One flight timing watch/device known as the Aviation Timer is a digital watch/device and two individual timers which indicate to the pilot the occurrence of a preprogrammed timed event by an LCD and audio alarm. The audio alarm is activated at a one-minute countdown before the occurrence of the timed event. The aviation timer also includes a magnetic backing so that it can be affixed to a metal structure within the cockpit. Although advertised in an aviation supply catalog, this watch/device is not provided by an aviation company since pilots are not allowed to place a magnet in an aircraft cockpit without an FAA-approved inspection and recalculation of magnetic deviation in the cockpit. The two timers are inadequate for most flights. This watch/device relies on its audio to inform the pilot of the occurrence of the timed event. However, audio alarms have proven inadequate for reliable use in general aviation aircraft.

A flight timing watch/device known as the Digital Timer includes a timer that may be programmed for a timed event of 1 second to 99 minutes. The timer gives off an audio alarm at the one-minute warning and again at the occurrence of the preprogrammed timed event. The timer includes a warning that the audio alarm may be ineffective in noisy airplanes.

A flight timing watch/device known as the Vertech Pilot Instrument includes a flight watch/device that indicates to the pilot in-flight information, including flying altitude, rate of climb or descent, vertical feet climbed during a flight, and barometer readings. Preprogrammed timed events are indicated to the pilot by means of an audio or display alarm. This watch/device was originally designed to be utilized in hang gliders and sailplanes, not in general aviation aircraft. The information provided by such watches/devices as this is not FAA approved for use in a general aviation or commercial aircraft.

A flight timing watch/device known as the Quartz Aircraft Clock is a watch/device that is mounted into the instrument panel of the aircraft. This timing watch/device uses only its LCD to relay information to the pilot.

A flight timing watch/device known as the Astrotech Digital Quartz Chronometer is a three-button chronometer that may be wired into the electrical system of the aircraft for visual display purposes. The chronometer visually indicates to the pilot on an LCD the occurrence of a preprogrammed timed event.

U.S. Pat. No. 5,361,241 to Ferrara et al., Nov. 1, 1994, discloses a wristwatch that alerts the wearer by vibrations to the watchband after a timed event occurs. The overall design of this device is inadequate for practical use as a flight watch/device.

U.S. Pat. No. 5,365,497 to Born, Nov. 15, 1994, discloses a time reliance motor that vibrates after a timed event occurs. This device has a silent alarm capability in response to an event. Although patented four years ago this device has not made it into production as yet. I assume because it has to high a voltage drain for a timepiece.

U.S. Pat. No. 5,233,572 to McCarty, Jr., Aug. 3, 1993, discloses a wrist device which provides the wearer with a succession of vibration prompts in response to a predetermined happening. The device also requires input by the wearer in response to the prompts. This device is designed to prompt a wearer for the purpose of behavioral reinforcement. It has nothing to do with flying an aircraft.

U.S. Pat. No. 4,290,128 to Estabrook, Apr. 4, 1980, and U.S. Pat. No. 3,631,452 to Richard, Dec. 28, 1971, discloses a work-scheduling device for indicating when different work projects are ready to be performed. This device has multiple-time-tracking capability and operates much like a lap timer. There is no silent alarm capability.

U.S. Pat. No. 3,820,105 to Assmus et al., Jun. 25, 1974, discloses a simple electronic signaling device. This device is designed to work in analog clocks. It is not designed to be used in flight and is not practical for use in flight.

U.S. Pat. No. 4,236,375 to Komaki, Dec. 2, 1980 discloses an electronic watch that can also communicate in Morse Code. This device contains three timer circuits; one time, one chronograph and one time elapsed. It uses only an audio signal to alert the wearer of the occurrence of a timed event and is not capable of practical use as a flight watch/device.

U.S. Pat. No. 4,731,603 to McRae et al. Mar. 15, 1988 discloses a tactile alarm system for gaining the attention on an individual without use of sound or light. It particularly relates to a system for gaining the attention on an individual who for gaining the attention on an individual who for medical or other reasons is unable to hear. The present invention further relates to a system wherein the individual whose attention is to be gained need not have to see. It has no direct relation to aviation.

U.S. Pat. No. 5,282,181 to Entner et al. Jan. 25, 1994 discloses a silent alarm timepiece to be worn on the person which provides a silent mechanism alarm in the for of tactile stimulus to the wearer when the chosen alarm time is reached. To my knowledge this device has still not been manufactured. I assume because it has to high a voltage drain for a timepiece.

Many of the above-described devices have aspects of the design that I have created. None of them have any practical use in flight beyond very basic timing functions. My flight watch/device is specifically designed to meet explicit in-flight needs and customizable to the needs of a particular flight. No other timepiece has been designed to fulfil the multiple and changing needs of the general aviation pilot.

OBJECTS AND ADVANTAGES

Accordingly several objects and advantages of the present invention are:

(a) to provide an improved flight watch/device for use by pilots that provides immediate and convenient access to pertinent in-flight safety related data including fuel management, navigation, position awareness, and compliance with FAA regulations by user programmable synchronous or unsynchronized timing capabilities;

(b) to provide a sufficient number of timers and alarms, including audio, visual, and tactile, to address in flight needs without abandoning a timing function due to a lack of timers;

(c) to provide a simple and adequate method to increase the safety of flight by virtue of comprehensive time tracking ability, and alarm methods, alerting the pilot of an aircraft of the occurrence of time critical events in a prioritized sequence, as determined by the pilot, and the needs of the flight;

(d) to provide a flight timing watch/device that addressees only flight timing needs for cockpit resource management information gathering, thus reducing anxiety and increasing flight safety by increasing the integrity of timing related knowledge;

(e) to provide a way to differentiate between timer and clock alarms by frequency, i.e. slow clock alarms, fast timer alarms; and number of alerts, i.e. Timer One beeps once & LED flashes once, Timer Two beeps twice and LED flashes twice, et cetera.

(f) to provide a flight timer that alerts the pilot of the obligation to close the flight plan thus reducing the frequency of false alarms and preventing commencement of search and rescue;

(g) to provide a flight timer that gives instant access to Zulu time, all available alpha-code aviation time zones, as well as ½ hour, 15 minute, and deviations from the alpha standard;

(h) to provide the ability to set alarms in other time zones for pilots that frequently change time zones, as well as lock out changes in accordance with regional time zone requirements and provide a simple method of changing the home time zone for setting alarms in other time zones, and instant access five time zones;

Further objects and advantages include providing a more advanced ability in a flight timing device to ensure pilot awareness of event occurrences, and increase flight safety. With proper use, this flight watch/device will greatly reduce the likelihood of fuel exhaustion accidents. Still further objects and advantages will become apparent from the ensuing description and accompanying drawings.

REFERENCE NUMERALS IN DRAWINGS

FIG. 1

| BUTTON | TIMER MODE | CLOCK MODE |
|---|---|---|
| 1 | Timer 1 & 2 to Display | Clock 1 Zone/Date to Display |
| 2 | Timer 3 to Display | Clock 2 Zone/Date to Display |
| 3 | Timer 4 to Display | Clock 3 Zone/Date to Display |
| 4 | Timer 5 & 6 to Display | Clock 4 Zone/Date to Display |
| 5 | Timer/Clock Toggle | Timer/Clock Toggle |
| 6 | Memory Recall | 12/24 Clock Display Toggle |
| 7 | Timer Increment | Alarms Test Pulse/ LED's/Tone |
| 9 | Timer Decrement | Time Zone Scroll Menu |
| 10 | Tone Alarm On/Off | Tone Alarm On/Off |
| 11 | Pulse Alarm On/Off | Pulse Alarm On/Off |
| 12 | Hour | Month |
| 13 | Minute | Day |
| 14 | Second | Year |
| 15 | Timer Start/Stop | Clock Start |
| 16 | Timer Reset | Clock Reset |
| 17 | Zulu Hot Key | Zulu Hot Key |
| 18 | Beep Tone Alarm | Beep Tone Alarm |
| 19 | LCD DISPLAY | LCD DISPLAY |
| 21 | AM/PM indicator | AM/PM Indicator |
| 22 | Beep Tone On/Off Display | Beep Tone On/Off Display |
| 23 | Pulse On/Off Indicator | Pulse On/Off Indicator |
| 24 | Timer one start connect | Time Zone Lock-Out Changes |
| 26 | Timer/Clock Select and Mode Indicator | Timer/Clock Select and Mode Indicator |
| 28 | Timer Numerals Display | Clock/Date Numerals Display |
| 29 | A LED for Timer 1 Alarm | A LED for Clock 1 Alarm |
| 30 | A LED for Timer 2 Alarm | A LED for Clock 2 Alarm |
| 31 | A LED for Timer 3 Alarm | A LED for Clock 3 Alarm |
| 32 | A LED for Timer 4 Alarm | A LED for Clock 4 Alarm |
| 33 | Encasement | |
| 34 | 360 degree Bezel | |

FIG. 2

36 Tone Emitter—beep tone alarm

37 Motor—pulse alarm

Figure 1:
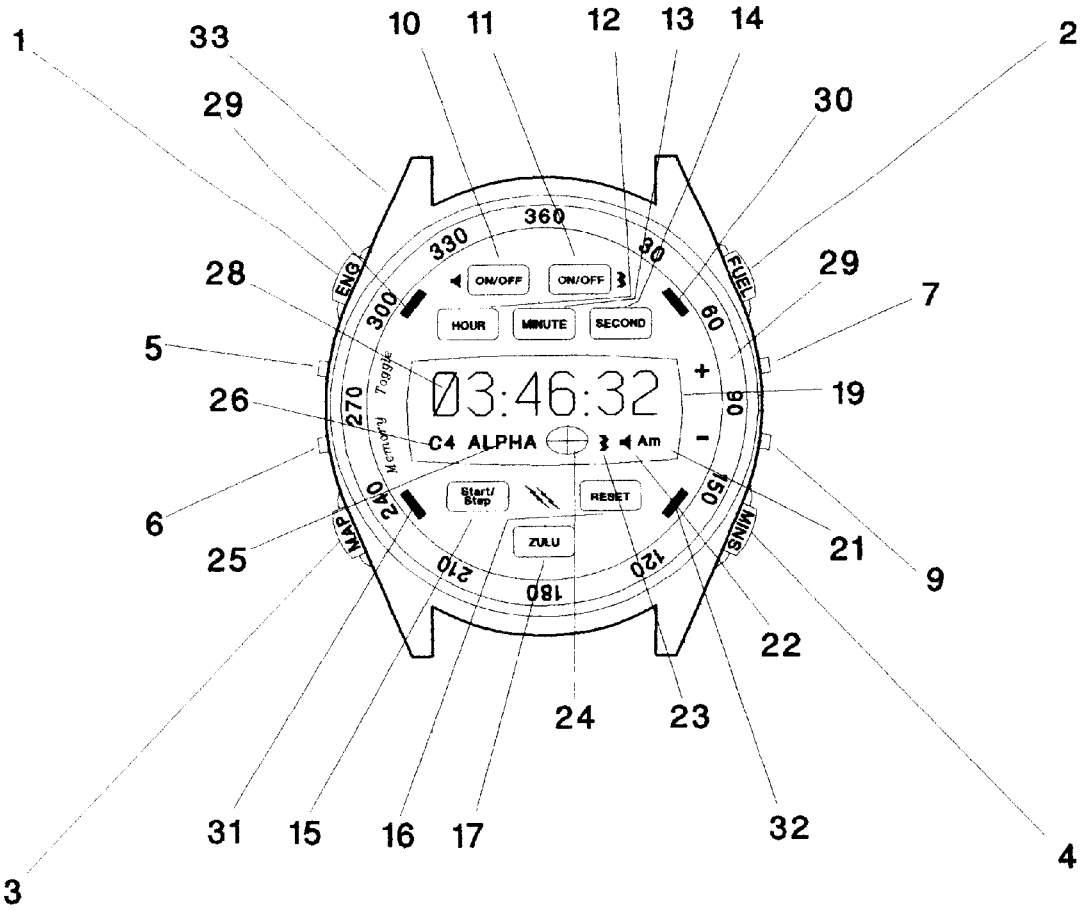
FIG. 1 depicts the face of an instant flight watch/device in accordance with the invention.
Figure 3:
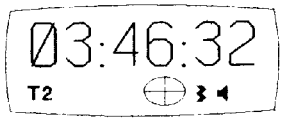
FIG. 3 depicts the liquid crystal display while the instant flight watch/device shown in FIG. 1. is in timer mode.

FIG. 3 Liquid crystal display in timer mode of instant flight watch/device shown in FIG. 1.

Figure 4:
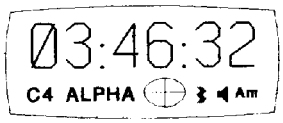
FIG. 4 depicts the liquid crystal display while the instant flight watch/device shown in FIG. 1. is in clock mode.

FIG. 4 Liquid crystal display in clock mode of instant flight watch/device shown in FIG. 1.

Figure 5:
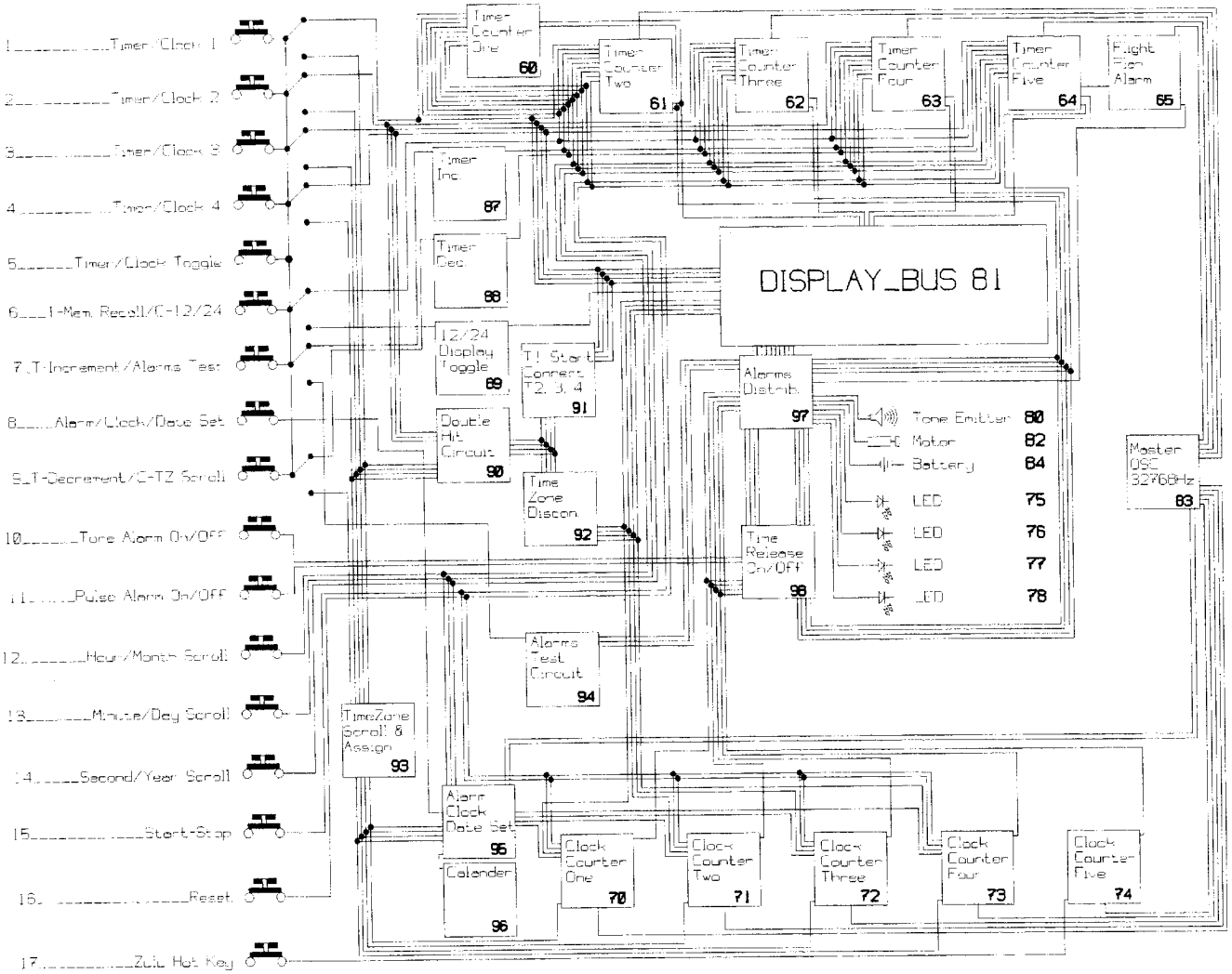
FIG. 5 depicts signal flow and software modules, which regulate the activity within the integrated circuit of the instant flight watch/device shown in FIG. 1, as directed by user input.

FIG. 5 Integrated Circuit Software and Connections

Buttons 1–17—surface buttons (see FIG. 1)

60 Timer one software module

61 Timer two software module

62 Timer three software module

63 Timer four software module

64 Timer five software module

65 Timer six software module (close flight plan alarm)

70 Clock one software module

71 Clock two software module

72 Clock three software module

73 Clock four software module

74 Clock five software module

75 LED—light emitting diode alarm

76 LED—light emitting diode alarm

77 LED—light emitting diode alarm

78 LED—light emitting diode alarm

80 Tone emitter-beep tone alarm

81 Display bus—information window

82 Motor—pulse alarm

83 Master clock—crystal oscillator

84 Battery

87 Timer Increment

88 Timer Decrement

89 12/24 Display Toggle

90 Timer Comply Hit/Hold (depress or hold button)

91 Timer one Start/Stop Connect to timer two, three, four run

92 Time Zone Disconnect

93 Time Zone Scroll and Assign

94 Alarms Test Circuit

95 Alarm Clock and Date Set

96 Calendar

97 Alarms Distribution

98 Time Release On/Off and Stop

Figure 6:
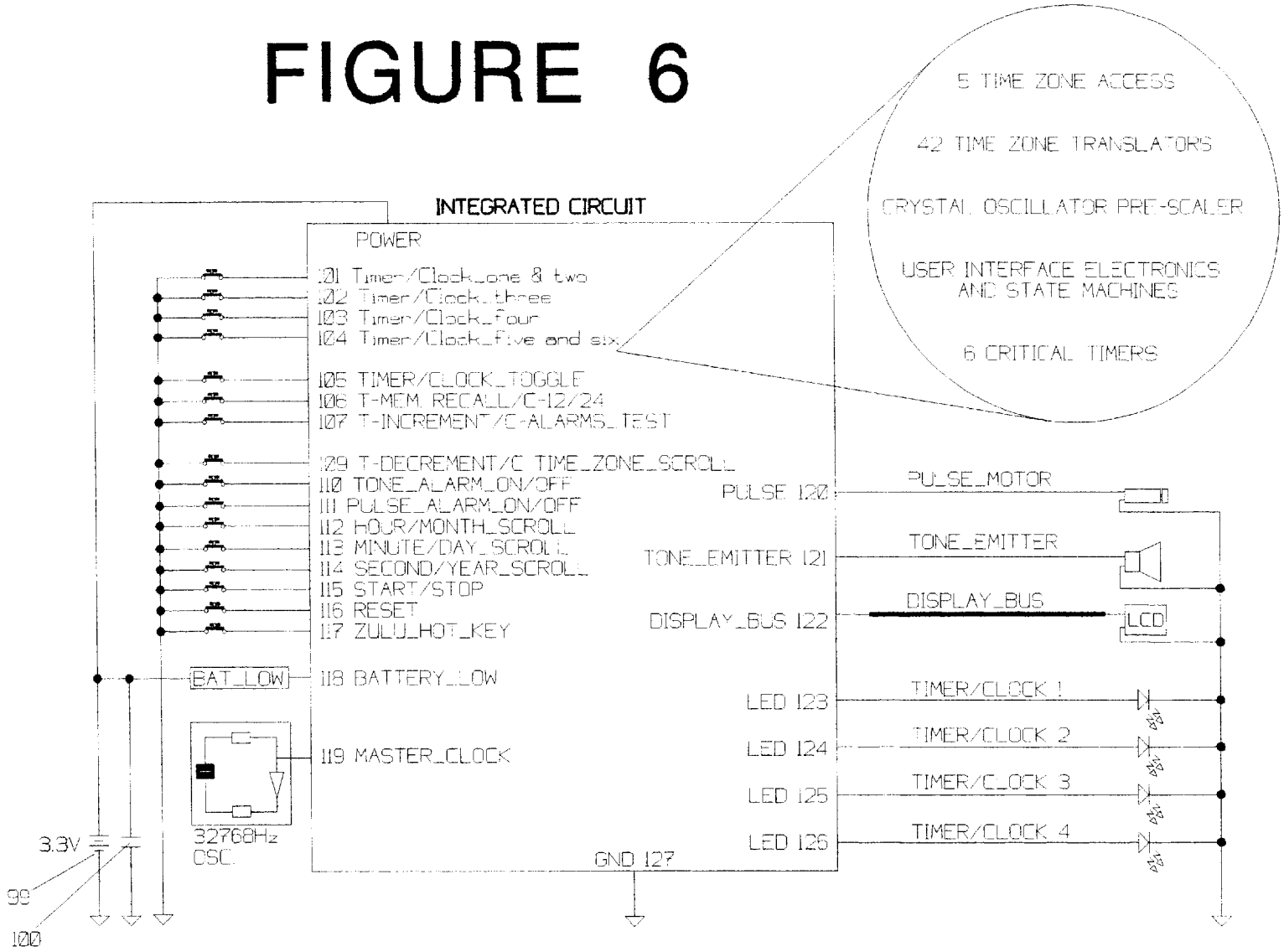
FIG. 6 depicts an integrated circuit and its connectivity to the user interface components, a battery, a charged capacitor, a low battery software component, and a master clock oscillator.

FIG. 6 Microprocessor/Integrated Circuit

99 Battery

100 Charged Capacitor

101 Timer/clock 1 and 2 circuit connection to button 1 (see FIG. 1)

102 Timer/clock 3 circuit connection to button 2 (see FIG. 1)

103 Timer/clock 4 circuit connection to button 3 (see FIG. 1)

104 Timer/clock 5 and 6 circuit connection to button 4 (see FIG. 1)

105 Timer/Clock Toggle circuit connection to button 5 (see FIG. 1)

106 Timer memory recall and 12/24 display circuit connection to button 6 (see FIG. 1)

107 Timer increment/alarms test circuit connection to button 7 (see FIG. 1)

109 Timer decrement/time zone menu scroll circuit connection to button 9 (see FIG. 1)

110 Beep tone alarm on/off circuit connection to button 10 (see FIG. 1)

111 Pulse alarm on/off circuit connection to button 11 (see FIG. 1)

112 Hour/month scroll circuit connection to button 12 (see FIG. 1)

113 Minute/day scroll circuit connection to button 13 (see FIG. 1)

114 Second/year scroll circuit connection to button 14 (see FIG. 1)

115 Start/Stop and clock start circuit connection to button 15 (see FIG. 1)

116 Timer Reset and clock reset circuit connection to button 16 (see FIG. 1)

117 Zulu hot key circuit connection to button 17 (see FIG. 1)

118 Battery Low sensor circuit connection to display bus 122 (see FIG. 1)

119 Master Clock Oscillator

120 Circuit connection to pulse motor

121 Circuit connection to tone emitter

122 Circuit connections to display bus LCD 19 (see FIG. 1)

123 Circuit connection to LED timer/clocks associated with button 1 (see FIG. 1)

124 Circuit connection to LED timer/clocks associated with button 2 (see FIG. 1)

125 Circuit connection to LED timer/clocks associated with button 3 (see FIG. 1)

126 Circuit connection to LED timer/clocks associated with button 4 (see FIG. 1)

127 Circuit connection to ground state

All of these descriptions within the Figures are further explained in the description and operations sections of this document. All aspects of this design are easily translated into current watch manufacturing technology.

DESCRIPTION FIG. 1—Overall Surface Layout and Functions

FIG. 1

FIG. 1 shows an instant flight watch/device in accordance with the invention. The flight clock has side buttons 1–7 and 9 and face buttons 10–17 which control the internal timer and clock functions of the flight watch device; LED indicators 29–32 for the emission of light in response to the occurrence of a preprogrammed event; and an information window 19 which includes information indicators 21–26 and 28.

The following buttons provide the following respective functions:

A first timer is controlled by button 1 and is used as a count-up timer for engine run time.

A second timer is controlled by button 1 and is used as a count-up timer for time to fix, timed turns or holding pattern timing, depending on the needs of the flight.

A third timer is controlled by button 2 and is used to time fuel tank switching, time to fix, timed turns or holding pattern timing, depending on the needs of the flight.

A forth timer is controlled by button 3. It is used to time flight between two radio navigation points in space. They are the final approach fix, and the missed approach point. This timing procedure is used to land an aircraft without visual reference to the ground. Button 3 can also used for time to fix, timed turns or holding pattern timing as the needs of the flight dictate.

A fifth timer is controlled by button 4 and is used to countdown to visual flight rules/instrument flight rules minimums, including fuel on board and consumption rate which dictates total flight time available, and personal safety margins.

A sixth timer is engaged automatically in association with timer five, when timer five is attached to timer one start. This is the close flight plan alarm circuit 65. This circuit will issue its alarm based on the start time in association with a timer one start whether or not timer five is stopped during operation. Only the engine run timer, timer one, can pause the timer six countdown.

A clock/timer toggle is controlled by button 5 and is used to change the display and function of the flight watch device. In clock mode the buttons and display service clock functions. In timer mode the buttons and display service timer functions.

In timer mode button 6 is used in conjunction with buttons 1–4 to enable the timer memory recall function. In the clock mode button 7 enables the change of clock time display between 12-hour and 24-hour formats.

In the timer mode a button 7 is used to increment timers 1–4 while in timer mode by manipulation of button 7. In clock mode button 7 may be used to test the alarms, pulse, LED's, and tone emitter.

While in timer mode button 9 is used to decrement the selected hours, minutes, and seconds of the timers. While in clock mode, time zones may be scrolled for assignment to clock buttons by buttons 1, 2, 3, and 4.

A button 10 is used for activation or deactivation of an internal audio alarm 36 indicated on or off by the display of the audio alarm symbol 22.

A button 11 is used for activation or deactivation of an internal pulse alarm 37 indicated on or off by the display of the pulse alarm symbol 23.

In timer mode, button 12 is used for selecting, and incrementing hours, and enabling increment button 7 and decrement button 9. In date set mode, button 12 is used for setting the month, and also enables enabling increment button 7 and decrement button 9.

A button 13, in timer mode, is used for selecting, and incrementing minutes, and enabling increment button 7 and decrement button 9. In date set mode, button 13 is used for setting the day, and also enables enabling increment button 7 and decrement button 9.

A button 14, in timer mode, is used for selecting, and incrementing seconds, and enabling the increment button 7 and decrement button 9. In date set mode, button 14 is used for setting the year, and also enables enabling increment button 7 and decrement button 9.

Buttons 1, 2, 3, 4, 7, and 9 may be used in conjunction with surface buttons 12, 13, and 14, which activate hour, minute, and second clock functions, respectively. In addition, all the buttons may be used in conjunction with surface buttons 15, 16, and 17 which may be used to control start/stop, reset, and Zulu hot key functions, respectively.

A button 15 is used for starting and stopping each selected internal timer.

A reset button 16 is used for resetting any of the timer and clock functions to a zero state.

A Zulu hot key 17 is used to display the current Zulu time. Zulu time is the time in Greenwich, England. Zulu time is also known as Greenwich Mean, or Meridian, Time (GMT) or Coordinated Universal Time (UTC). Aviation uses the term Zulu, the phonetic term for the letter assigned to the last time zone of the 26 existing time zones, as defined by the military Defense Mapping Agency. Zulu is the standard reference time by which pilots, when filing a flight plan, report to Flight Watch, and Flight Service, both services of the FAA.

INFORMATION DISPLAY SECTION (Liquid Crystal Display)

The display of the instant flight watch/device mode and functions comprises an information window 19 centrally located on the face of the flight watch/device. The information window comprises a plurality of symbols, which when illuminated, indicate the status of each individual operation of the function of the flight timers.

In clock mode the selected one of five internal clocks is indicated by the letter "C" followed by a number at position 26 in the information display window which corresponds to the selected clock. In the timer mode the selected one of six internal timers is indicated by the letter "T" followed by a number at position 26 in the information display window which corresponds to the selected timer.

When the internal pulse motor is on and ready to give off a pulse upon the occurrence of elapsed timers or clock alarms, pulse on/off indicator 23 is illuminated.

When an audio alarm is on and ready to emit an audio beep tone upon the occurrence of elapsed timers or clock alarms, audio alarm on/off indicator 22 is illuminated.

AM/PM indicator 21, shown in the information window 19 indicates the AM/PM distinction.

The hours, minutes and seconds of selected timers and clocks are displayed in the timer/clock numerals at position 28, in the form of six digital numerals.

The flight watch/device is used for two distinct functions. In timer mode it is designed to service in flight timing needs which are flight and pilot dependent. In clock mode it is designed to assist the use in identifying time zones and setting alarms in those time zones. As complex as it may seem the actual operation is very simple. The functions are arrayed in such a way as to be self-explanatory. A typical in-flight use would include, during preflight, data entry for IFR or VFR minimums, the first time to fix, or the first time to switch fuel tanks, and the FAF to MAP. Timer 1 is used for engine run time and is started at engine start. Timer six is automatically started in association with timer five when timer five is connected to timer one start.

The clock features may be used for keeping track of time zones frequently traveled between, or appointment setting for businessmen that work nationally, or internationally.

Figure 2:
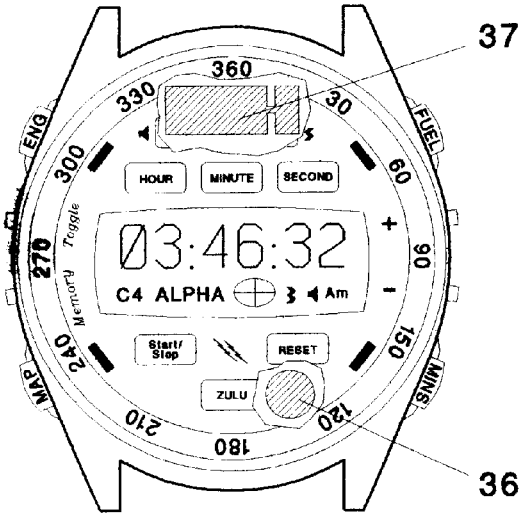
FIG. 2 depicts the mounting of a tactile alarm and a tone emitter alarm within an encasement of the instant flight watch/device shown in FIG. 1.

DESCRIPTION FIG. 2—Watch Face with Cutaways

FIG. 2 shows the instant flight clock face with cutaways to reveal the following key internal components: audio alarm indicators 36; and tactile alarm 37.

An alarm 36 is a tone emitter, which provides a beep tone in response to elapsed timers 1–6 and clock alarms 1–4.

An alarm 37 is a motor, which provides a pulse vibration in response to elapsed timers 1–6 and clock alarms 1–4.

DESCRIPTION FIG. 3—LCD in Timer Mode

FIG. 3 is a depiction of the visible elements of the liquid crystal display of the flight watch device in timer mode.

DESCRIPTION FIG. 4—LCD in Clock Mode

FIG. 4 is a depiction of the visible elements of the liquid crystal display of the flight watch device in clock mode.

DESCRIPTION FIG. 5—Signal Flow and Software Components

FIG. 5 displays buttons 1–17, which are synonymous with those depicted in FIG. 1. Also displayed is the signal flow diagram for the integrated circuit. This signal flow diagram depicts the various software components of the program. These sections interact to form the entirety of the circuit, which controls the various functions of the flight watch/device.

A timer circuit 60, written in software within the master integrated circuit, that runs as a count up or count down timer. Timer counter one may be used as an engine run timer.

A timer circuit 61, written in software within the master integrated circuit, that runs as a count up or count down timer. Timer counter one may be used for time to fix, fuel tank switching, timed turns, or holding pattern timing.

A timer circuit 62, written in software within the master integrated circuit, that runs as a count up or count down timer. Timer counter one may be used for time to fix, fuel tank switching, timed turns, or holding pattern timing.

A timer circuit 63, written in software within the master integrated circuit, that runs as a count up or count down timer. Timer counter one may be used for final approach fix to missed approach point, time to fix, fuel tank switching, timed turns, or holding pattern timing.

A timer circuit 64, written in software within the master integrated circuit, that runs as a count up or count down timer. Timer counter one may be used for countdown to instrument flight rule, or visual flight rule minimums.

A timer circuit 65, written in software within the master integrated circuit, that runs in conjunction with timer five in order to alert the user of the obligation to close the flight plan 15 minutes after the VFR/IFR minimums have been reached. If the alarm is not fully acknowledged it will repeat again 30, and again 45 minutes after the VFR/IFR minimums have been reached. To acknowledge the initial alarm hit the start/stop button 15 or the reset button 16 once. To disable the second occurrence of the alarm, while timer five is selected, press and hold reset for one half of a second. This will clear the alarm occurrence memory. This circuit will issue its alarm based on the start time in association with a timer one start whether or not the timer five is stopped during operation. It will only clear in accordance with the above parameters or by hitting reset 16 twice while timer five, button 4, is selected.

A clock circuit 70, written in software within the master integrated circuit, that can have any one of 42 time zones assigned to it for hot key access.

A clock circuit 71, written in software within the master integrated circuit, that can have any one of 42 time zones assigned to it for hot key access.

A clock circuit 72, written in software within the master integrated circuit, that can have any one of 42 time zones assigned to it for hot key access.

A clock circuit 73, written in software within the master integrated circuit that can have any one of 42 time zones assigned to it for hot key access.

A clock circuit 74, written in software within the master integrated circuit, that allows the user to access Zulu time, otherwise known as Greenwich Mean Time, or Universal Time Coordinated by pressing button 17 (see FIG. 1).

An input bus circuit 83, written in software within the master integrated circuit, that monitors the master oscillator crystal to drive the timers, clocks, and calendars.

A timer increment circuit 87, written in software within the master integrated circuit, utilized in conjunction with button 7, increments the user-selected numerals for hours, minutes, and seconds, as desired. For example, if the user were setting a countdown timer, the user could select hour, minute, or second, and increment each individually. This also works for setting the main clock, and the date.

A timer decrement circuit 88, written in software within the master integrated circuit, utilized in conjunction with button 9, decrements the user selected numerals for hours, minutes, and seconds, as desired. For example, if the user were setting a countdown timer, the user could select hour, minute, or second, and decrement each individually. This also works for setting the main clock, and the date.

A circuit 89, written in software within the master integrated circuit, controls the display of the time in 12-hour, or 24-hour formats.

A circuit 90, written in software within the master integrated circuit, that enables the use of double and triple hits, as well as button hold time to perform functions within the Flight Watch device.

A circuit 91, written in software within the master integrated circuit, that controls the timer one start/stop of timers 2–3. This is the double-hit circuit. By depressing any of the timer buttons 2, 3, and 4 in rapid succession, two times, the pilot may connect or disconnect that individual timing circuit from the timer one start. The status of timer one connect, displays in the status section of the information window shown in FIG. 1, position 24. For example, in the course of normal operation, the pilot may choose to have all four timers start at engine start. As in when timer one is selected, and start 15 is depressed. Likewise, depending on the need of that flight, the pilot may elect to disconnect certain timers from timer one start.

A circuit 92, that written in software within the master integrated circuit, which controls the ability to lockout changes pertaining to regional time zone requirements. This circuit works in conjunction with the triple-hit circuit 34 by double hit manipulation of buttons 1–4 while in clock mode. The status of the status of the time zone lockout changes displays in the status section of the information window shown in FIG. 1, position 24 while in clock mode.

A circuit 93, written in software within the master integrated circuit, that enables the time zone menu and time zone scroll ability in order to pick and choose desired time zones to be accessed by buttons 1–4 (see FIG. 1) while in clock mode.

A circuit 94, written in software within the master integrated circuit, that enables the testing of the alarms to verify working status by manipulation of button 7 in clock mode.

A circuit 95, written in software within the master integrated circuit, which enables the setting of the alarm, clocks, and date.

A circuit 96, written in software within the master integrated circuit, that contains programming for the calendar from incept date into the future.

A circuit 97, written in software within the master integrated circuit, that controls the acceptance of instruction to engage alarms and distributes the proper response to the correct alarm including available combinations of alarms 29–32, and 36–37.

A circuit 98, written in software within the master integrated circuit, that disables the possibility of inadvertent changes on critical running timers including the starting and stopping of timers 1–4, the tone alarm on/off button 10, and the pulse alarm on/off button 11.

The clock may be affixed by a metal band, cloth straps, or a contact adhesion material (not shown).

The visual alarm of the clock may include rapid flashing when a timer alarm expires and slow flashing when a clock alarm expires.

The visual alarms may include a number of flashes that coincide with the timer, or clock, with which it is associated, i.e. 1–6 flashes.

The audio alarms may include a number of beeps that coincide with the timer, or clock, with which it is associated, i.e. 1–4 beeps.

The audio alarm may provide a rapid emitting beep tone when timer alarm expires and a slow emitting beep tone when a clock alarm expires.

FIG. 6 Integrated Circuit/Microprocessor

A battery 99 to power the microprocessor/integrated circuit, information display, LED's, pulse and tone alarms.

A charged capacitor 100 to keep flight watch device circuitry charged during battery change.

101 Timer/clock 1 and 2 circuit connection to button 1 (see FIG. 1) to interface user to microprocessor, and microprocessor to alarms/displays. –102 Timer/clock 3 circuit connection to button 2 (see FIG. 1) to interface user to microprocessor, and microprocessor to alarms/displays.

103 Timer/clock 4 circuit connection to button 3 (see FIG. 1) to interface user to microprocessor, and microprocessor to alarms/displays.

104 Timer/clock 5 and 6 circuit connection to button 4 (see FIG. 1) to interface user to microprocessor, and microprocessor to alarms/displays.

105 Timer/Clock Toggle circuit connection to button 5 (see FIG. 1) to interface user to microprocessor, and microprocessor to alarms/displays.

106 Timer memory recall and 12/24 display circuit connection to button 6 (see FIG. 1) to interface user to microprocessor, and microprocessor to alarms/displays.

107 Timer increment/alarms test circuit connection to button 7 (see FIG. 1) to interface user to microprocessor, and microprocessor to alarms/displays.

109 Timer decrement/time zone menu scroll circuit connection to button 9 (see FIG. 1) to interface user to microprocessor, and microprocessor to alarms/displays.

110 Beep tone alarm on/off circuit connection to button 10 (see FIG. 1) to interface user to microprocessor, and microprocessor to alarms/displays.

111 Pulse alarm on/off circuit connection to button 11 (see FIG. 1) to interface user to microprocessor, and microprocessor to alarms/displays.

112 Hour/month scroll circuit connection to button 12 (see FIG. 1) to interface user to microprocessor, and microprocessor to alarms/displays.

113 Minute/day scroll circuit connection to button 13 (see FIG. 1) to interface user to microprocessor, and microprocessor to alarms/displays.

114 Second/year scroll circuit connection to button 14 (see FIG. 1) to interface user to microprocessor, and microprocessor to alarms/displays.

115 Start/Stop and clock start circuit connection to button 15 (see FIG. 1) to interface user to microprocessor, and microprocessor to alarms/displays.

116 Timer Reset and clock reset circuit connection to button 16 (see FIG. 1) to interface user to microprocessor, and microprocessor to alarms/displays.

117 Zulu hot key circuit connection to button 17 (see FIG. 1) to interface user to microprocessor, and microprocessor to alarms/displays.

118 Battery Low sensor circuit connection to display bus 122 (see FIG. 1) to warn user when battery needs to be changed.

119 Master Clock Oscillator is a reference for all timer and clock software modules to drive time increments for counting time.

120 Circuit connection to pulse motor to microprocessor to alarm pulse.

121 Circuit connection to tone emitter to interface microprocessor to alarm tone.

122 Circuit connections to display bus LCD 19 (see FIG. 1) to interface microprocessor to display.

123 Circuit connection to LED timer/clocks associated with button 1 (see FIG. 1) to interface microprocessor to LED alarm.

124 Circuit connection to LED timer/clocks associated with button 2 (see FIG. 1) to interface microprocessor to LED alarm.

125 Circuit connection to LED timer/clocks associated with button 3 (see FIG. 1) to interface microprocessor to LED alarm.

126 Circuit connection to LED timer/clocks associated with button 4 (see FIG. 1) to interface microprocessor to LED alarm.

127 Circuit connection to ground state.

Operation of Flight Watch—(See FIG. 1.)

User friendly design of the watch/device allows the pilot convenient access to critical functions. Four timer/clock buttons 1–4 placed around the perimeter of the watch/device are logically arranged and clearly marked. Each timer/clock has its own colored LED that flashes when a timed event occurrence expires, allowing quick identification of the timer/clock and event. A rapid emitting of the indicators signifies timer events, while clock events are signified by a slow emitting of the indicators. The beep tone alarm will beep a number of times with regard the timer it is associated with, i.e. two rapid beeps for timer two, three rapid beeps for timer 3, et cetera. Beeping is successively repeated until acknowledged.

All timers, when counting down to zero, pass through the zero mark and proceed counting in the negative time direction, thereby providing the wearer with the time duration passed since the zero mark had occurred.

Flight Timer Functions: During pre-flight, the pilot calculates flight duration, fuel on board, and fuel consumption. Then the pilot enters the appropriate data into the flight timer as follows:

The pilot should test the alarms by hitting, in clock mode, button 7. This will flash all LED's, emit audio, and activate the motor to verify operational integrity.

The pilot may choose to mount the flight watch/device on the yoke, which is the mechanism connected to the ailerons and elevators of the aircraft (like a steering wheel). When doing so, the pilot should verify that the tactile alarm is not engaged by checking that indicator 23 is not visible, indicating that the motor is disengaged. This is to save the battery. If engaged, the motor can be disengaged by hitting button 11 for one-full second.

When the watch/device is worn on the wrist the pilot should verify that the tactile alarm is engaged by checking that indicator 23 is visible, indicating motor engaged. If disengaged the motor can be engaged by hitting button 11 for one-full second.

If asked to shut down while waiting for tower clearance, the pilot will select timer 1, and then press stop 15. All timers connected to the timer one start/stop, will stop counting until start is pressed again, while timer one is selected.

Memory Recall: If the pilot wishes to reset an elapsed alarm to the previously programmed count? The pilot will stop the timer and depress memory recall button 6. The previously entered time will recall to the information window, indicating it is ready to be started.

To activate illumination of information window 20, during night flight, press and hold any of the timer/clock buttons 1–4 for one full second. This will cause (for the next six hours), the backlight to illuminate, for five seconds, whenever a button is depressed. Depress again to deactivate.

The most reliable manner to use the watch is for the pilot to wear it on the wrist while having the tactile alarm engaged. This is the most failsafe method to ensure pilot awareness of timed event occurrences.

Button 5 toggles between timer mode & clock mode.

Timer Mode Instructions:

During flight planning use Hour 12, Minute 13, Second 14, and +/− buttons to set timers. Timers can be set in accordance with in flight needs and personal preferences. The Flight Watch can handle tracking six events at a time. The Flight Watch timers can be used for: engine run time (flight duration); time to fix; timed turned; holding pattern timing; fuel tank switching; final approach fix to missed approach point; countdown to visual or instrument flight rule minimums, close flight plan alarm. To illuminate the information window press and hold any of the timer/clock buttons 1–4 for one full second, until beep is heard. This will enable a six-hour countdown timer that allows the backlight to come on for five seconds every time any of the perimeter or surface buttons are pressed. To test alarms go to clock mode by pressing button 5. Then press button 7. This will momentarily flash all LED's, beep, and pulse the watch to verify that all desired functions are on. If beep or pulse does not occur check to see if they are on by referring to symbols 22 and 23. If symbol is not visible press related buttons 10 and/or 11 to engage desired alarms.

Button One: Timer One and Timer Two 1

Button Two: Timer Three 2

Button Three: Timer Four 3

Button Four: Timer Five and Six 4

Timer One: Press Button 1, once. Reset to zero if necessary. Leave on zero for count up engine run time.

Timer Two: Press Button 1, two times. Set Hour/Minute/Second for countdown.

Timer Three: Press Button 2, one time. Set Hour/Minute/Second for countdown.

Timer Four: Press Button 3, one time. Set Hour/Minute/Second for countdown.

Timer Five: Press Button 4, one time. Set Hour/Minute/Second for countdown.

Timer Six: Auto function of Timer Five. Will Flash CFP (close flight plan) every fifteen minutes after the timer five reaches zero. Acknowledge by hitting Button 4 once, or disable alarm by hitting Button 4 three times.

A timer can be connected or disconnected from Timer One start by depressing its associated button three times. Note: if a timer is at zero state and connected to Timer One start it will begin counting up. If in flight and you want to change any such timer, select the timer, make sure it is disconnected from timer one start, and then hit stop.

Safety Features:

A running timer is locked out from changes, i.e. changes can only be performed if a timer is stopped and not connected to Timer One while timer one is running. If a pilot wishes to change a running timer that is connected to Timer One, he must select that timer, and stop it manually. As an added safety measure timers can only be changed within five seconds of button depression.

Flight Watch in the Cockpit:

At engine start, hit Timer One button 1 once, and then hit Start 15.

Clock Mode Instructions

The user has access to 42 time zones. Five time zones can be made available for instant access, i.e. hot key, by assigning desired time zones to buttons 1–4. The fifth time zone is always Zulu/GMT time, and is accessible by depressing button 17.

Button 1: User assignable home time zone one

Button 2: User assignable time zone two

Button 3: User assignable time zone three

Button 4: User assignable time zone four

Button 17: Greenwich Mean Time/Zulu

Keep in mind that setting any clock sets all clocks. Depress button 9 and scroll through time zones. Time zones will appear in alpha section 25 of the LCD 19. Press desired button and hold until beep is heard. Then press that button again two times to enter time set mode. The word "time" will appear in the alpha section. Set hour, minute, second. While in time set mode, increment and decrement buttons 7 and 9 will function as long as you see the word "time" in the alpha window. Use toggle 5 while in set mode to toggle AM/PM. Depress that clock button again to engage timer. All clocks are now set.

To set date, press selected clock three times to enter date set mode. The word "date" will appear in the alpha section of the LCD 25. Set month, day, year using the hour, minute, second buttons respectively. While in date set mode, increment and decrement buttons 7 and 9 will function as long as you see the word "date" in the alpha window. Depress the associated button you are working with again. All dates, for all time zones are now set. Flight Watch is Y2K compliant. To ensure you are setting the date in the correct century look at the oval symbol in the LCD 24. It will appear in date set mode. If no quadrants are dark you are in the 1900's. If one quadrant is dark you are in 2000's. Three quadrants, 2100's, et cetera.

To set an alarm in a specific time zone that is assigned to a hot key. Depress that hot key two times. Set hour, minute, second. Press that button again to engage. The alarm will ring in the home time zone.

To enable an alarm to ring in its own time zone instead of the home time zone. Depress that hot key two times. Set hour, minute, second. Depress selected clock button and hold until beep is heard. This is a one-time event.

To set alarms directly from the time zone menu: Scroll through time zones until you reach your desired time zone, then, hit either alarm buttons 10–11. Set hours, minutes, and seconds. Use toggle 5 while in set mode to toggle AM/PM.

Triple hitting any time zone other than the home time zone will automatically swap that button/time zone with the home time zone.

Note: Any time the reset button 16 is pressed while in time, date, or alarm set modes, numerals will reset to zero state. All modes will reset to default within five seconds of inactivity. To illuminate the information window press and hold any of the timer/clock buttons 1–4 for one full second until beep is heard. This will enable a six-hour countdown timer that allows the backlight to come on for five seconds every time any of the perimeter or surface buttons are pressed. The beep tone alarm will beep a number of times with regard the clock it is associated with, i.e. two slow beeps for clock alarm two, three slow beeps for clock alarm three, et cetera. Beeping is successively repeated until acknowledged.

Summary of Advantages

Accordingly the reader will see that the flight watch/device described provides significant advantages over prior art watches/devices and timepieces. This includes advantages in safety, function, and fashion, which combine to produce an ergonomically advanced in-flight watch/device.

- This flight watch/device provides a failsafe method and apparatus for indicating critical timed event occurrences by eliminating the need for additional pilot attention and monitoring of preprogrammed timed events.
- This flight watch/device also provides a method and apparatus for the elimination of ineffective audio and visual indications of the preprogrammed timed occurrence.
- The watch/device provides these and other features in a flight watch/device that sends a vibration to the wrist of the wearer upon the occurrence of a preprogrammed timed event. The vibration alerts the pilot as to a timed occurrence without distracting the pilot from the general operation of the aircraft.
- The watch/device eliminates the necessity of the audio signal. This allows the watch/device to operate effectively in noisy and other sensory depriving conditions by utilizing an indicating means that requires no pilot attention, after the initial preprogramming, that a timed event occurrence has transpired.
- The flight watch/device is compact and is worn on the wrist in the same fashion as basic watches.
- This watch/device is designed to provide timing information to the pilot that relates to timing considerations for fuel, en-route navigation, instrument flight, and compliance with FAA regulations, and includes the ability for the pilot to adapt its use to the changing needs of each individual flight.
- The watch/device also provides a method by which the pilot can rapidly identify specific elapsed timers by color coded LED's.
- The watch/device also provides a method by which the pilot can rapidly identify specific elapsed timers by the number of beeps in repeated succession.
- This watch/device also provides a method of reminding a pilot of his obligation to contact Flight Service to cancel the flight plan associated with the given flight, in order to prevent Search and Rescue operations from commencing.
- The flight watch/device I have described successfully addresses the timing needs of the general aviation pilot and relates the pertinent timing information which it tracks, to the pilot of an aircraft in flight, in a manner that is considerably more failsafe than any of the watches/devices which have preceded it.
- The flight watch/device is an economical solution for general aviation pilots who can not afford the installation of the much more expensive fuel flow tracking systems used in commercial aircraft. This invention has been designed to reduce the number of general aviation accidents caused by fuel exhaustion; provide a safe and reliable method by which the pilot is informed of important and essential event occurrences in the aircraft. All in all, it is a unique and beneficial watch/device that will save lives, reduce property damage, and save money for the government, insurance companies, and pilots.

Ramifications and Scope

While operation of this flight watch device has been described in conjunction with specific embodiments thereof, it is evident that many alternative, modifications and variations will be apparent to those skilled in the art. Accordingly, the preferred embodiments of the invention set forth herein are intended to be illustrative, not limiting. Various changes may be made without departing from the spirit and scope of the invention as defined in the following claims and their legal equivalents.

Most watches/devices that claim to be flight watches/devices have little to do with anything regarding actual flight. Those watches/devices that are designed to be used in a cockpit, i.e. flight timers, cannot be considered failsafe due to the limitations of their design. What is unique about this invention includes the following features:

- It is the only flight watch that can run six timers simultaneously in an interrelated manner to alert the wearer as to timed fuel related, and navigation related events, as selected and programmed by the pilot.
- It is the only flight watch that has a failsafe means of alerting the pilot of an event occurrence via utilization of a tactile alarm upon the happening of a preprogrammed event so as to alert the wearer of the occurrence of an event, during flight, without continuous visual or auditory monitoring.
- It is the only flight watch that combines auditory, visual and tactile alarms to ensure pilot awareness of a multitude of event occurrences.
- It is the only flight watch that has all Military Alpha coded time zones as well as all alternative time zones for those countries that deviate from hourly changes.
- It is the only flight watch that alerts the pilot of his obligation to close his flight plan.

Although the description above contains many specificities, these should not be construed as limiting the scope of the invention but as merely provideing illustrations of some of the presently preferred embodiments of this invention. For example, the encasement can have other shapes and use different materials in its fabrication. The timer buttons can be reassigned for other uses. The battery can be solar powered. The time setting can be derived by radio frequency means. The entire device can be constructed for panel mounting within an aircraft and transmits a signal to the tactile alarm, or be used with only visual and auditory alarms.

Thus the scope of the invention should be determined by the appended claims and their legal equivalents, rather than by the examples given.

What is claimed is:

1. A flight signal device to be worn by the user comprising:

a. means for providing time indication for fuel tank switching;

b. means for providing time indication for implementing navigation regulations;

c. means for providing a plurality timer count-ups and count-downs associated with a respective plurality of preprogrammed events;

d. means for providing humanly sensible indication alarms for a plurality of preprogrammed timer and clock events activated upon the occurrence of one of said preprogrammed events comprising a tactile device;

e. means activated upon the occurrence of a different one of said preprogrammed events for providing a second humanly sensible indication which is different from said first humanly sensible indication comprising visual devices;

f. means activated upon the occurrence of a different one of said preprogrammed events for providing a third humanly sensible indication which is different from said first and second humanly sensible indications comprising and auditory device;

g. means for providing a selectable visual display of a plurality of timers for a plurality of respective timed events and 26 world time zones and alternative time zones for areas not corresponding to hourly time changes;

h. means for programming and reprogramming a plurality of in-flight events, including a count-up timer for engine run time, a plurality of count-down timers for fuel tank switching, time to fix event timer, timer for timing turns, timer for holding patterns, timer for timing final approach fix to missed approach point, minimum fuel requirement for IFR and VFR flights, and a close flight plan alarm;

i. means for providing a selected number of signals in succession of the auditory or visual alarms for identifying specific events.

2. A flight signal device according to claim 1, further including a watch housing, said alarm means comprises an electro-mechanical motor for vibrating said watch housing, or and electrical impulse transmitted from said watch housing or tactile means for alerting the wearer of an event occurrence.

3. A flight signal device according to claim 1, further including fastening means for fastening the device to a user's body.

* * * * *